US005343933A

United States Patent [19]

Schneider et al.

[11] Patent Number: 5,343,933

[45] Date of Patent: Sep. 6, 1994

[54] PROCESS AND APPARATUS FOR CONTINUOUSLY CASTING METALS

[75] Inventors: Wolfgang Schneider, St. Augustin; Horst-Dieter Lindlar, Hennef; Roland Schmoll, Bonn, all of Fed. Rep. of Germany

[73] Assignee: VAW Aluminium AG, Fed. Rep. of Germany

[21] Appl. No.: 14,405

[22] Filed: Feb. 5, 1993

[30] Foreign Application Priority Data

Feb. 6, 1992 [DE] Fed. Rep. of Germany ..... 4203337

[51] Int. Cl.[5] ..... B22D 11/07; B22D 11/16

[52] U.S. Cl. ..... 164/452; 164/487; 164/472; 164/475; 164/415; 164/420; 164/154.1

[58] Field of Search ..... 164/487, 440, 472, 268, 164/475, 415, 420, 154, 452

[56] References Cited

U.S. PATENT DOCUMENTS 4,157,728 6/1979 Mitamura ..... 164/4
5,170,838 12/1992 Theler ..... 164/452

FOREIGN PATENT DOCUMENTS 0218855 10/1989 European Pat. Off. .
0372946 6/1990 European Pat. Off. .
0449771 10/1991 European Pat. Off. .
3533517 4/1987 Fed. Rep. of Germany .
A2359662 2/1978 France .

*Primary Examiner*—Kuang Y. Lin
*Attorney, Agent, or Firm*—Perman & Green

[57] ABSTRACT

Process and apparatus for the continuous casting of aluminum alloys in multiple moulds to form continuous castings of improved quality. The invention comprises supplying gas at a predetermined gas flow rate to each mould during the mould filling stage, sensing the gas pressure during the second casting or cooling stage and increasing or reducing the gas flow rate to maintain a predetermined gas pressure in the moulds during the continuous extrusion process.

37 Claims, 4 Drawing Sheets

PROCESS AND APPARATUS FOR CONTINUOUSLY CASTING METALS

BACKGROUND OF THE INVENTION

The present invention relates to a process and apparatus for continuously casting metals, especially aluminium or aluminium alloys, in a multiple mould casting system, with each mould being provided with an upper hot top attachment, a lower movable casting base or table, and with a pressurized gas and a lubricant being introduced into the mould cavity underneath the hot top attachment.

DISCUSSION OF THE PRIOR ART

A process of the aforementioned type is described in EP 0 218 855, in which the continuous casting mould is provided with a hot top attachment whose inner wall forms an overhang which protrudes beyond the inner wall of the continuous casting mould. It is at this overhang where the pressurized gas together with the lubricant is introduced into the cavity of the continuous casting mould. During the entire casting phase, the gas is introduced at a constant flow rate. In the case of multiple mould casting systems the gas supply system is designed in such a way that all moulds are supplied with the same constant quantity of gas.

However, it has been found that with this type of operation, improved results with respect to the surface quality and quality of edge structure of all continuously cast bars or ingots can be achieved only if casting conditions are completely interference-free. In practice, interference-free conditions hardly ever exist. Particularly in multiple mould casting systems, frequently it is found that certain moulds require different quantities of gas. Furthermore, the gas requirements of individual moulds may change during the casting operation. In particular, this applies to moulds with a diameter in excess of 25 cm. In addition, it has been found that the setting for the gas quantity has to be monitored regularly. Even under normal casting conditions the quantity of gas required by each particular mould frequently changes. In consequence, with this type of operation it is not possible to achieve uniformly good ingot qualities because it is common, within a particular mould system, to find ingots or cast bars whose overall quality is reduced and/or whose quality changes considerably along the length of the casting.

EP 0 449 771 discloses another process of the aforementioned type in which a higher quantity of gas is set for the start of the filling operation, which gas quantity is reduced considerably as the level of metal in the mould rises. When the ingot subsequently enters the water-cooled zone, a cold run occurs due to a higher degree of shrinkage of the ingot. The gap between the metal and mould wall increases in the process so that a very large quantity of gas is required to maintain the pressure pad or air curtain in the mould cavity. This process usually does not occur exactly simultaneously and to the same degree in the individual moulds of a multiple casting system so that, to maintain the air curtain or gas pad, the moulds require different quantities of gas. This also applies to other types of interference which may occur in the individual moulds during the casting process, such as the occurrence of a crack in the hot top or insufficient lubrication of the inner mould wall due to interference in the supply of separating agents. According to the process described, the gas supply can only be controlled simultaneously, and to the same degree, for all moulds within the main gas supply line. In this way it is not possible to ensure that the necessary gas pad is maintained in each individual mould. This necessarily leads to at least some castings produced in some of the moulds of the casting process suffering from a reduction in quality.

It is therefore desirable and advantageous to develop a process in which any interference in the casting operation is compensated for directly so that an optimum billet, bar or ingot quality is achieved. In particular, it is desirable to obtain castings having a high surface quality and a high quality of edge structure in multiple mould casting systems.

SUMMARY OF THE INVENTION

In accordance with the process of the present invention, the gas for each mould of a multiple, direct chill mould casting system is supplied via at least one gas pipeline comprising a control valve for regulating the flow rate of gas volume, a downstream pressure sensor and a device for recording the volume of gas flow. During a first casting phase, extending from the moment when the mould starts to be filled with liquid metal up to the point in time after the metal ingot has entered the water-cooled region, the gas flow rate is automatically kept constant at a predetermined value, independently of the respective filling level of the mould. During the subsequent second casting phase, the gas flow rate in each gas pipeline is automatically controlled or regulated in such a way that the gas pressure in the pipeline is kept constant at a predetermined value.

In this way it is possible to prevent or quickly stop any cold run problems during the initial casting phase and any interference in the casting operation during the stationary casting phase.

DETAILED DESCRIPTION

Figure 1:
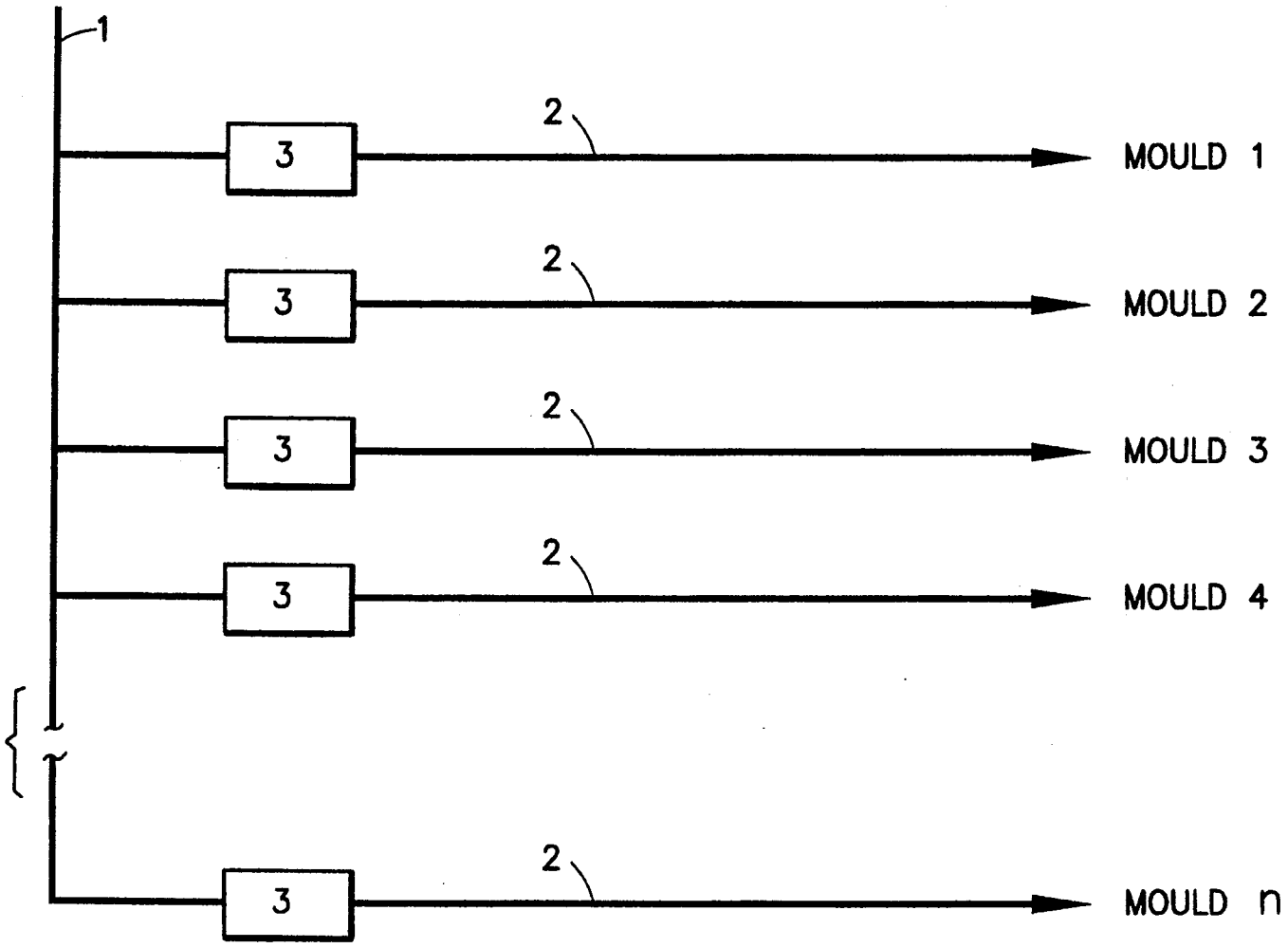
FIG. 1 is a diagrammatic illustration of a multiple-mould casting system in which the main gas pipeline has branches to a plurality of moulds, each branch having a gas flow control unit.

The principle of the gas supply system as used according to one embodiment of the present invention is diagrammatically illustrated in FIG. 1. Gas pipeline sections 2 branch off from a main gas pipeline 1 and lead to the individual moulds of the multiple mould casting system, with at least one gas pipeline section 2 leading to each mould. Each gas pipeline section 2 comprises a measuring and control unit 3 for measuring and controlling the flow of gas volume and the gas pressure.

Figure 2:
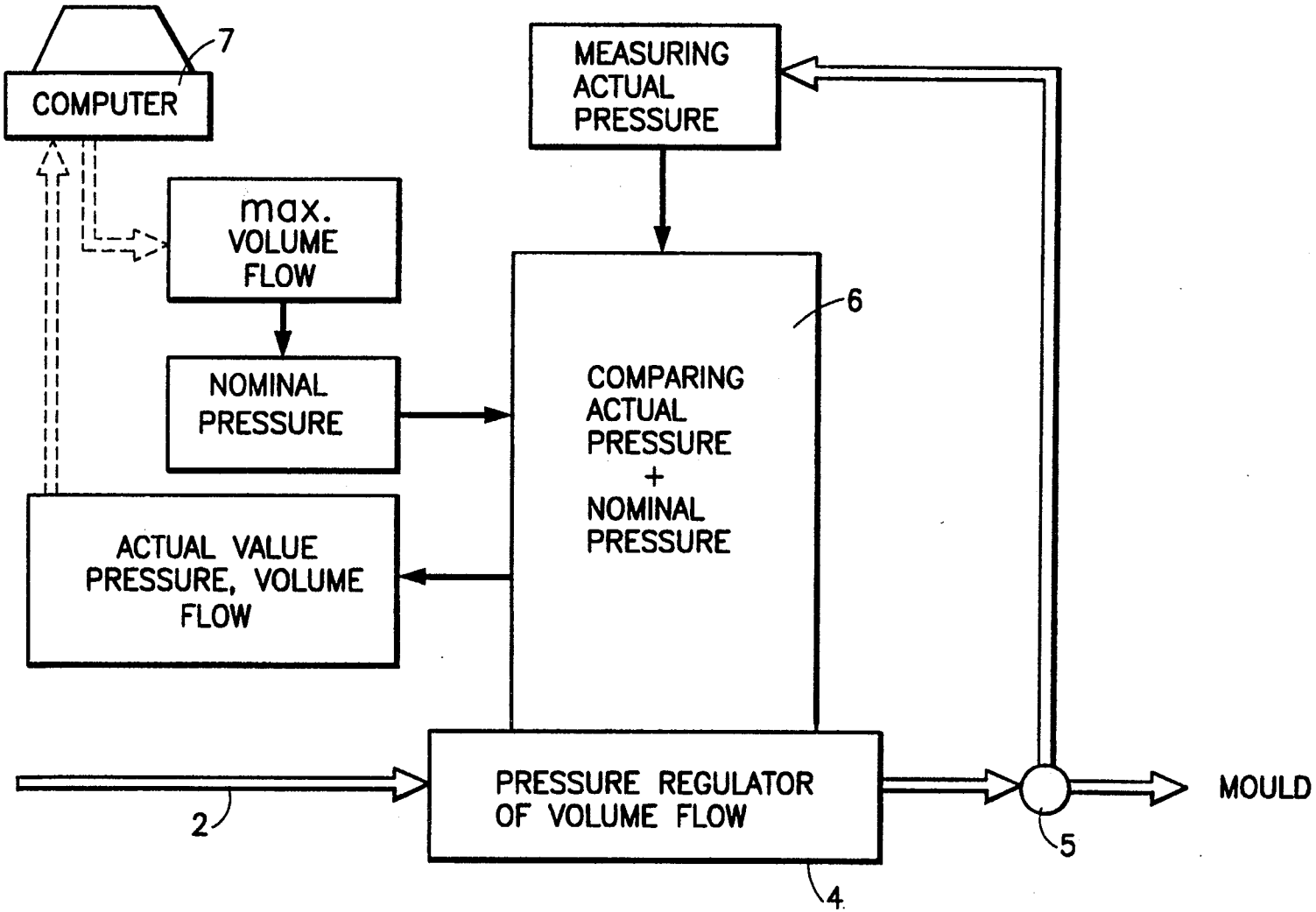
FIG. 2 is a flow chart illustrating the components of the individual gas flow control units on each of the gas pipeline branches leading to each mould.

FIG. 2 diagrammatically illustrates the operating principles of the measuring and control units 3 of FIG. 1. Each gas pipeline section 2 contains a device 4 which comprises a measuring instrument for recording the flow of gas volume, and an electronically controllable control valve for regulating the flow rate of gas volume.

A pressure sensor 5 measures the actual value of the gas pressure in each gas pipeline section 2. A nominal pressure value, optionally also including an upper and/or lower limit value range for the flow of gas volume or, alternatively, a nominal value for the flow of gas volume, may be predetermined in an electronic control unit 6. The control valve is controlled by the control unit 6 in accordance with the predetermined values. The values to be set may optionally be fed in by a process computer 7, e.g. in accordance with pre-selectable casting programs for different types of moulds and/or different alloys.

In a preferred embodiment of the process in accordance with the invention, a nominal pressure value for the individual gas pipelines leading to the moulds is predetermined. In such a case, the flow rate of gas volume in each gas pipeline from the onset of casting (empty moulds) is controlled in such a way that the rate of flow of gas volume is increased if the pressure measured in the gas pipeline is lower than the nominal pressure value, and it is decreased if the pressure measured is higher than the nominal pressure value. The flow rate is limited to a predetermined maximum value because otherwise, if there was no counter-pressure or air curtain, an unlimited amount of air would enter the mould. At the same time, this type of process ensures that the flow of gas volume during the initial casting phase remains constant at a predetermined maximum value until the mould has cooled to such an extent that the metallostatic pressure in the mould corresponds to the predetermined nominal pressure value. In accordance with the process of the present invention, the operation of filling the moulds is controlled in such a way that this point is not reached until the cast ingots have reached the water-cooled region.

Figures 3A, 3B, 3C:
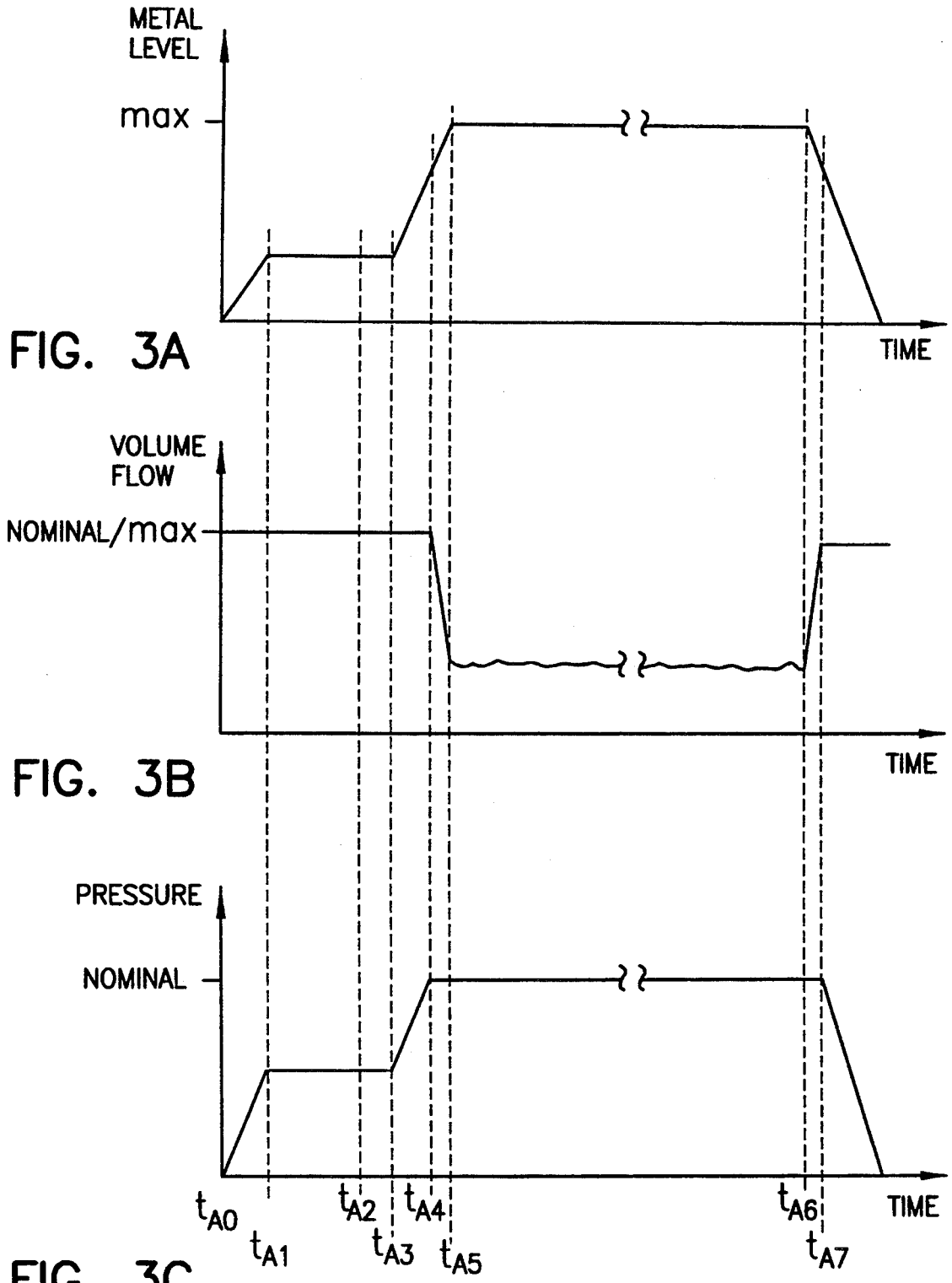
FIGS. 3 and 4 are time sequence charts illustrating the casting sequence of the present process relative to gas pressure, gas flow rate and metal level, the embodiment of FIG. 4 providing increased filling speeds for the moulds.

FIG. 3 illustrates the casting sequence of the present process, using the time-dependent values for the metal level in the mould and for the flow of gas volume as well as the gas pressure in the gas pipeline leading to a mould. The process of filling the mould begins at the point in time $t_{AO}$. From the onset of the filling operation, the gas flow rate has the predetermined maximum value. The pressure measured in the gas pipeline rises as the metal level in the mould rises. When the metal has reached a level which is preferably 50% to 85% below the maximum filling level, the level of metal in the mould is initially kept constant at such a value (point in time $t_{A1}$). The gas pressure remains constant accordingly. At approximately this point in time, the casting table is lowered. At the point in time $t_{A2}$, the lower part of the cast ingot enters the water-cooled region (direct cooling). Until a cast length approximately corresponding to half the ingot diameter or half the ingot thickness is reached ($t_{A3}$), the level of metal in the mould is kept constant, with a uniform maximum flow of gas volume. In this way it is ensured that in spite of an increasing gap between the metal and mould wall due to a higher degree of shrinkage of the ingot, an adequate gas pad or air curtain is maintained in this critical region.

Subsequently, the level of metal is made to rise further. The gas pressure increases accordingly, and the flow of gas volume remains constant until the measured gas pressure has reached the predetermined nominal pressure value. In the example given, this is the case at the point in time $t_{A4}$. In accordance with pressure losses possibly occurring in the gas pipeline at a maximum flow of gas volume (depending on the cross-section and length of the individual gas pipelines), this point in time is reached shortly before the mould is filled completely. From this point in time onwards, the gas pressure is automatically kept constant at the predetermined nominal pressure value. The gas flow rate required for maintaining this pressure clearly drops up to the point in time ($t_{A5}$) when the mould is filled completely. During the further casting sequences, under normal operating conditions, only slight changes in the gas flow rate are required for accurately keeping the pressure constant at the predetermined nominal value. Emptying of the mould starts at the point in time $t_{A6}$. As the level of metal is lowered, the gas flow rate increases to the predetermined maximum value if the gas pressure continues to be kept constant. After the point in time $t_{A7}$, the gas pressure decreases to zero, with the mould being completely empty.

The above-described pressure control system may also be used for a continuously rising mould filling level. The filling speed is controlled in such a way that the level of metal, at which the measured pressure in the gas pipeline corresponds to the predetermined nominal value, is not reached until after the cast billets have entered the direct cooling region.

Figures 4A, 4B, 4C:
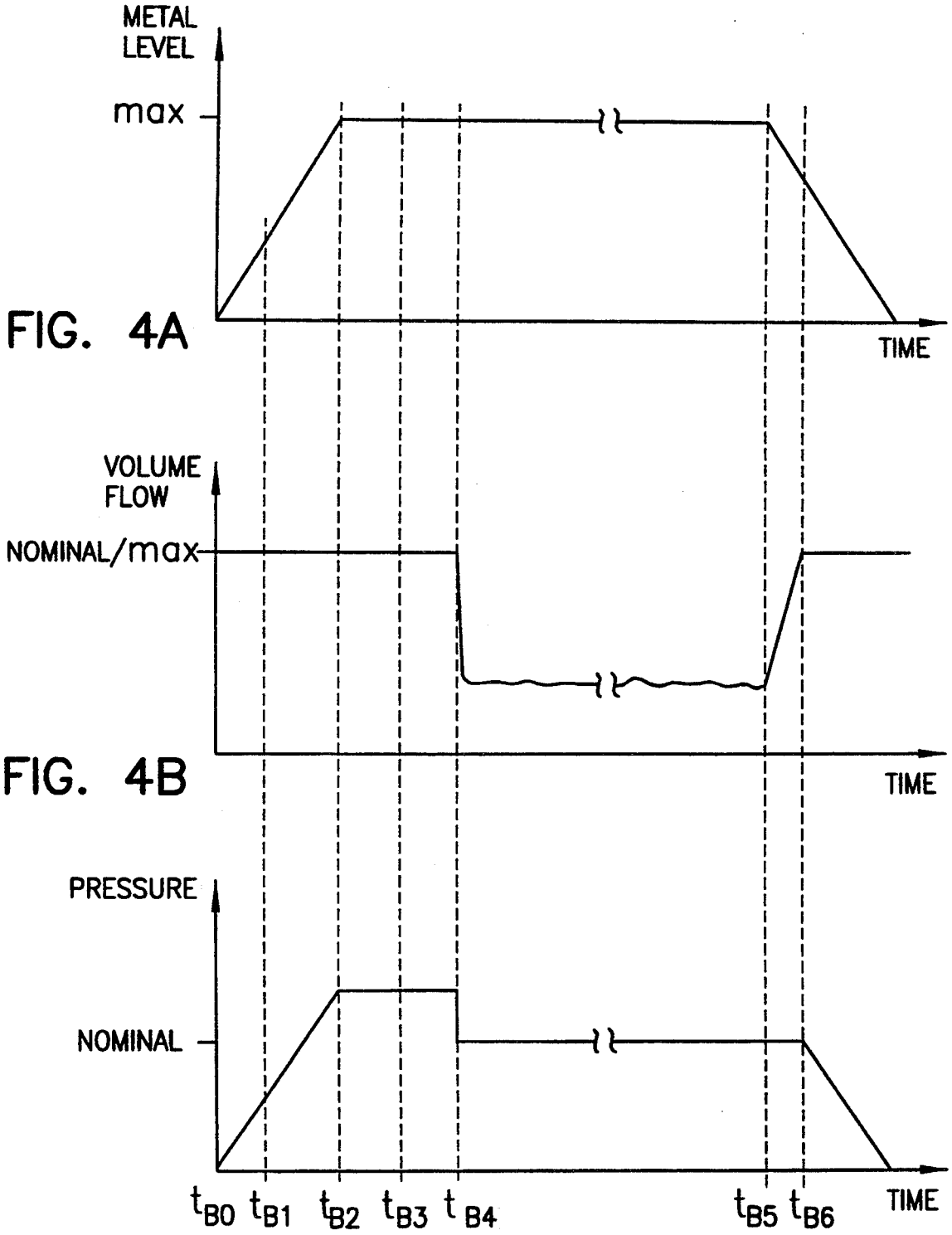

According to a further embodiment of the process of the present invention, it is also possible to operate at higher filling speeds. In such a case, a nominal value for the gas flow rate is predetermined in the first casting phase. Independently of the gas pressure, the flow of gas volume is kept constant at this nominal value until after the cast billets or ingots have entered the direct cooling region. Only then is it permitted to switch over to a constant pressure control. A casting sequence in accordance with this embodiment is illustrated in FIG. 4.

The process of filling the moulds begins at the point in time $t_{B0}$. From the start of the filling operation, the gas flow rate is kept constant at the predetermined nominal value. This nominal value is preferably selected in accordance with the maximum value of the flow of gas volume at a constant pressure control. Lowering of the casting table commences at the point in time $t_{B1}$. The pressure measured in the gas pipeline increases with a rising level of metal and reaches a maximum value at $t_{B2}$, with the mould being filled completely. This maximum value is in excess of the nominal pressure value predetermined for the second casting phase. This is due to the pressure losses possibly occurring in the gas pipeline at a maximum flow of gas volume (depending on the cross-section and length of the individual gas pipelines). At the point in time $t_{B3}$, the cast billets or ingots enter the direct cooling zone. The flow of gas volume or gas flow rate is kept constant at the predetermined nominal value up to the point in time $t_{B4}$. This means that in this application, also, a sufficient gas pad or curtain is ensured in the critical phase when the ingot or billet enters the direct cooling zone. It is only at this point in time that the change-over to constant pressure control in accordance with the description of FIG. 3 takes place. The gas pressure is reduced to the predetermined nominal pressure value and during the further casting operation is kept constant at this value. If a maximum value for the flow of gas volume is predetermined for the phase of constant pressure control, emptying of the moulds takes place as described in connection with FIG. 3.

The maximum or nominal value to be determined for the flow of gas volume in accordance with the process proposed by the invention is independent of the level of metal in the mould. It is determined as a function of the shape of billet to be cast. In the case of continuously casting aluminium and its alloys, the values to be used range between 0.2 and 2.0 nl/h per mm circumference of the cavity of the respective mould. To achieve optimum casting conditions, a value of about 0.32 Nl/h per mm circumference of the cavity of the mould used has been found to be particularly advantageous. By specifying such a maximum value for the flow of gas volume it is possible not only to achieve the advantages mentioned above but also to ensure that, if unusual defects occur such as the formation of cracks or leads in the gas supply system, an unlimited high flow of gas volume cannot occur.

In a further preferred embodiment of the process of the present invention, the range of the flow of gas volume is set at a lower limit by predetermining a minimum value. In this way it is ensured that even if there is interference in the casting sequence, which leads to a high counter pressure which is in excess of the predetermined nominal pressure value or the metallostatic pressure of the melt, for instance if the passage of gas in the casting direction is obstructed, a minimum flow of gas volume is introduced into the mould cavity so that a gas pad between the metal and mould wall is maintained. For aluminium and aluminium alloys, values ranging between 10 and 130 Nl/h which are independent of the mould cavity, have been found to be advantageous. Preferably, a minimum value of approximately 20 Nl/h is predetermined.

In the case of the method of operation according to FIGS. 3 and 4, the gas flow rate at the end of the casting phase has the set maximum value. As the level of metal in the mould is lowered, it has not been possible to prevent gas from being blown through the melt. This leads to a deterioration of the billet quality in the region of the top end, for example as a result of oxide inclusions and/or undesirable high gas contents. In such a case, more metal has to be cut off at the top end of the billet, which leads to considerable metal losses. This may be avoided according to the present invention, for example, by reducing, in stages or continuously, the predetermined nominal pressure value after a certain cast billet length or casting time has been arrived at, as a result of which the gas flow rate is automatically lowered when emptying the mould. It is also possible to predetermine a constantly low gas flow rate during this end phase. The values to be set in such a case are preferably selected from the above-mentioned range of minimum values for the flow of gas volume. The reduced values for the nominal pressure value for the flow of gas volume are preferably predetermined by a program of the process computer 7 (FIG. 2).

To ensure accurate control of the gas supply, the pre-pressure of the gas in the main gas pipeline is set to a value of at least 2 bar. The minimum inner diameter of the gas pipeline sections 2 leading to the individual moulds is selected to be such that the pressure losses in the gas pipelines at the gas flow values occurring in the gas pipelines during the second casting phase (constant pressure control) are negligibly low. Under such conditions, the nominal pressure value can be set to be such that, when the mould is filled almost completely, it is almost identical to the metallostatic pressure or is only slightly in excess thereof. In particular, these conditions are reached if the inner diameter of the gas pipelines is at least 6 mm.

The process in accordance with the invention can advantageously be used for continuously casting aluminium and aluminium alloys in round billet moulds (circular cross-section), rolling billet moulds (rectangular cross-section) and oval billet moulds with straight side walls and semi-circular end walls. Because the air supply to the individual moulds is controlled separately, according to the present invention, it is possible, especially when casting rolling billets, to use moulds of different types and/or dimensions in the same multiple mould casting system. In such a case, the process parameters to be predetermined are adapted to the respective mould types.

In the case of large mould types, especially with rolling or oval billet moulds, with cross-sections from approximately 1050 to 300 mm, it has been found to be advantageous to supply the gas to the individual moulds via several gas sub-pipelines, with, for example, 1 to 2 gas sub-pipelines being guided to each mould side and 1 gas sub-pipeline to each mould end.

The flow of gas volume and pressure are measured and controlled separately in each gas sub-pipeline in accordance with FIG. 2, the flow of gas volume in each gas sub-pipeline being allocated an upper limit in the form of a percentage of the total maximum value predetermined for the respective mould, such percentage being dependent on the distance between the gas sub-pipelines on the circumference of the mould cavity. The nominal pressure value to be predetermined for each gas sub-pipeline is unaffected by the number of gas sub-pipelines per mould.

Air or nitrogen are particularly suitable gases for the process in accordance with the invention.

A substantial advantage of the process of the present invention, inter alia, consists in that the lubricant supplied together with the gas can be introduced with a constant flow of volume, which means that, as far as the lubricant supply is concerned, there is no need for extensive control facilities. To maintain optimum casting conditions, the lubricant is introduced at a constant flow rate ranging between 0.1 and 1.0 ml/h per mm circumference of the cavity of the respective mould. It is advantageous to use lubricants whose viscosity at 40° C. ranges between 35 and 220 $m^2/s$. In particular, this group includes rape oil and castor oil.

The process in accordance with the present invention is used for continuously casting simultaneously in multiple mould casting systems in which, in the stationary casting phase, operations take place at a constantly high level of metal in the moulds. The individual moulds are filled simultaneously. Equally, the cast billets are lowered simultaneously via a casting table. Under the conditions as described, it is possible, even in the initial casting phase, to build up an adequate gas pad in each mould of the system and maintain it during the entire casting phase. As the gas supply is controlled separately for each mould, each mould receives the exact amount of air which ensures optimum operating conditions. In this way it is possible to produce largely defect-free castings, including ingots, bars or billets, with a constantly high surface quality. Any cold run problems are avoided when the castings enter the direct cooling zone. Any interference which might occur in the stationary casting phase is compensated for directly or avoided altogether due to the fact that the gas pressure can be kept accurately constant through automatic control of the gas flow rate, even if slight deviations from the predetermined nominal value occur. Furthermore, by specifying suitable casting programs via a process computer it is possible to develop an almost fully automatic casting system.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

We claim:

1. A process for casting of continuous metal billets, ingots or bars in a multiple mould casting apparatus in which each mould comprises a hot top attachment, a movable casting base or table and a gas pipeline for introducing pressurized gas to said mould, comprising the steps of (a) supplying gas through each pipeline to each mould at a predetermined flow rate during a first casting-initiation step from the moment of introducing molten metal to each said mould until after the movable casting base is lowered and a portion of said metal casting is cooled; (b) sensing the gas pressure in said pipeline, and (c) automatically adjusting the gas flow rate to maintain the gas pressure at a predetermined nominal value during the formation of said continuous castings in a second casting step.

2. Process according to claim 1 in which said mould is completely filled with molten metal after said gas pressure reaches said predetermined nominal value.

3. A process according to claim 1 in which, during the second casting step, the actual value of the gas pressure in each gas pipeline is measured and compared with a predetermined nominal value, and the gas flow rate is increased if the actual value of the gas pressure is lower than the predetermined nominal value and decreased if the actual value of the gas pressure is higher than the predetermined nominal value.

4. A process according to claim 1 in which the moulds are only partially filled with liquid metal before the mould enters the water-cooled region and the gas flow rate in each gas pipeline is kept constant up to the point in time between the metal casting entering the water-cooled region and the mould being filled completely and at which the gas pressure in the gas pipeline reaches the predetermined value, and that after such point in time, the gas flow rate in each gas pipeline is automatically controlled in such a way that the gas pressure in each pipeline section is kept constant at the predetermined value.

5. A process according to claim 4 in which, during the initial casting phase up to a point in time after the metal casting has entered the water-cooled region, the metal bath level is kept constant at a low value which is between 50% and 85% below the maximum filling level in the hot top, and that thereafter the mould is filled completely.

6. A process according to claim 1 in which, during the first and the second casting steps, the actual value of the gas pressure in each gas pipeline section is measured and compared with a predetermined nominal value, and the gas flow rate is increased if the actual value of the gas pressure is lower than the predetermined nominal value and decreased if the actual value of the gas pressure is higher than the predetermined nominal value.

7. A process according to claim 1 in which the gas flow rate is regulated below a predetermined maximum value.

8. A process according to claim 7 in which the predetermined maximum value is a value between 0.2 and 2.0 Nl/h per mm circumference of the mould cavity.

9. A process according to claim 8 in which the predetermined maximum value is a value of approximately 0.32 Nl/h per mm circumference of the mould cavity.

10. A process according to claim 1 in which the gas flow rate is regulated above a predetermined minimum value.

11. A process according to claim 10 in which, independently of the circumference of the mould cavity, the predetermined minimum value is a value between 10 and 130 Nl/h.

12. A process according to claim 11 in which the predetermined minimum value is approximately 20 Nl/h.

13. A process according to claim i in which the predetermined nominal value for the gas pressure in each gas pipeline corresponds to at least the metallostatic pressure of the melt when the mould is filled completely.

14. A process according to claim 3 in which, after a predetermined casting length or casting time has been reached, the predetermined nominal value for the gas pressure is decreased in step (c).

15. A process according to claim 1 in which, after a predetermined casting length or casting time has been reached, the gas flow rate is reduced to a predetermined constant value in step (c).

16. A process according to claim 15 in which, after a predetermined casting length or casting time has been reached, the gas flow rate is kept constant at the predetermined minimum value in step (c).

17. A process according to claim 1 in which the gas pressure in each pipeline is at least 2 bar.

18. A process according to claim 1 in which the minimum inner diameter of the gas pipeline is selected to be such that with a controlled gas flow rate the pressure losses in the gas pipeline are negligibly small as compared to the predetermined nominal value for the gas pressure.

19. A process according to claim 1 in which the inner diameter of the gas pipeline is at least 6 mm.

20. A process according to claim 1 which comprises supplying each mould with gas via a plurality of gas sub-pipelines, with the gas flow rate and gas pressure of each gas sub-pipeline being measured and controlled separately.

21. A process according to claim 20 in which the gas flow rate for each gas sub-pipeline has an upper limit corresponding to a maximum value predetermined for the mould.

22. A process according to claim 21 in which the same nominal gas pressure value is predetermined for each gas sub-pipeline of a mould, said nominal value corresponding to at least the metallostatic pressure of the melt when the mould is filled completely.

23. A process according to claim 1 in which, the gas used is air or nitrogen.

24. A process according to claim 1 in which a lubricant is introduced to the mould at a constant flow of volume.

25. A process according to claim 24 in which the lubricant is introduced at a flow of volume ranging between 01 and 1.0 ml/h per mm circumference of the mould cavity.

26. A process according to claim 24 in which the lubricant has a kinematic viscosity at 40° C. ranges between 35 and 220 $mm^2/s$.

27. A process according to claim 24 in which the lubricant is rape oil or castor oil.

28. A process according to claim 1 in which the moulds used are round billet moulds with a circular cross-section.

29. A process according to claim 1 in which the moulds used are rolling ingot moulds with a rectangular cross-section.

30. A process according to claim 1 in which the moulds used are oval ingot moulds with straight side walls and semi-circular end walls.

31. A process according to claim 1 in which moulds with different dimensions are used in the same multiple casting system, and different nominal gas pressure values are predetermined for each of said moulds.

32. A multiple mould casting apparatus for the continuous casting of metals in a plurality of moulds each comprising a hot top attachment having a pressurized gas supply and a movable casting base which is lowerable to a cooling zone to cool continuous metal castings formed in the mould cavity between said hot top attachment and said casting base, said apparatus comprising a pipeline connected to each mould for supplying pressurized gas downstream thereto; means for regulating the flow rate of said pressurized gas to each of said moulds; means for sensing the gas pressure in each said pipeline at a location downstream of said regulating means and upstream of each said mould, and means for automatically adjusting said regulating means to maintain the gas pressure in said pipeline at a predetermined nominal value, whereby the gas flow rate is maintained constant at a predetermined value, independent of the gas pressure, during the first casting phase in which the mould cavities are being filled with molten metal and the casting base is lowered to initiate cooling of the casting and, subsequently thereto, the gas flow rate is regulated to a higher or lower value whenever the sensed gas pressure varies from a predetermined nominal pressure.

33. An apparatus according to claim 32 in which said means for regulating the gas flow rate further comprises means for comparing the sensed pressure with a predetermined desired nominal gas pressure, to automatically actuate the gas flow regulating means whenever the sensed pressure is higher or lower than the nominal pressure.

34. An apparatus according to claim 33 in which said comparing means is associated with means for automatically actuating the gas flow regulating means whenever the sensed gas pressure reaches a value within a nominal pressure range including pressure values above and below the predetermined nominal pressure.

35. An apparatus according to claim 34 in which said gas flow regulating means is associated with control means for controlling the maximum gas flow rate at a predetermined value.

36. An apparatus according to claim 35 which further comprises a computer means associated with said gas flow regulating means and with said control means for regulating the gas flow rate at said maximum value during the first casting phase, to increase the filling speeds of the moulds.

37. An apparatus according to claim 32 in which each said gas pipeline comprises a sub-pipeline branch or section to each of the plurality of moulds.

* * * * *